US010480474B2

(12) United States Patent
Chandrakar et al.

(10) Patent No.: US 10,480,474 B2
(45) Date of Patent: Nov. 19, 2019

(54) METHOD AND SYSTEM FOR DETERMINING REMAINING USEFUL LIFE FOR AN INJECTOR OF A RECIPROCATING ENGINE

(71) Applicant: General Electric Company, Schenectady, NY (US)

(72) Inventors: Amit Chandrakar, Bangalore (IN); Rahul Srinivas Prabhu, Bangalore (IN); Mandyam Rangayan Sridhar, Bangalore (IN); Manoj Prakash Gokhale, Bangalore (IN)

(73) Assignee: GE Global Sourcing LLC, Norwalk, CT (US)

( * ) Notice: Subject to any disclaimer, the term of this patent is extended or adjusted under 35 U.S.C. 154(b) by 0 days.

(21) Appl. No.: 15/946,956

(22) Filed: Apr. 6, 2018

(65) Prior Publication Data

US 2018/0291856 A1 Oct. 11, 2018

(30) Foreign Application Priority Data

Apr. 6, 2017 (IN) ..... 201741012419

(51) Int. Cl.
*F02M 65/00* (2006.01)
*F02M 61/16* (2006.01)
(Continued)

(52) U.S. Cl.
CPC ..... *F02M 65/006* (2013.01); *F02D 41/1462* (2013.01); *F02D 41/1467* (2013.01);
(Continued)

(58) Field of Classification Search
CPC .. F02M 65/006; F02M 65/001; F02M 61/167; F02D 41/1462; F02D 41/1467;
(Continued)

(56) References Cited

U.S. PATENT DOCUMENTS 5,076,237 A 12/1991 Hartman et al.
6,857,263 B2 2/2005 Gray, Jr. et al.
(Continued)

FOREIGN PATENT DOCUMENTS

EP 1 600 351 B1 1/2007

OTHER PUBLICATIONS

Ballois, S.L., et al., "An experimental setup to study a hybrid drivetrain for a shunting locomotive," Eleventh International Conference on Ecological Vehicles and Renewable Energies (EVER), pp. 1-7 (Apr. 6-8, 2016).
(Continued)

*Primary Examiner* — Hung Q Nguyen
*Assistant Examiner* — Brian P Monahon
(74) *Attorney, Agent, or Firm* — McCoy Russell LLP

(57) ABSTRACT

A method and system for determining remaining useful life of an in-use injector of a reciprocating engine is disclosed. The method includes determining nozzle wear relationship data for different duty cycles of the in-use injector, and using the nozzle wear relationship data together with operating parameters for the reciprocating engine, and emission relationship data to determine actual emission levels for the in-use injector based on the wear relationship data and the emission relationship data. The method and system further include determining remaining useful life of the in-use injector based on actual emission levels and the nozzle wear relationship data; and controlling an operation of the reciprocating engine based on the actual emission levels.

13 Claims, 8 Drawing Sheets

(51) Int. Cl.

| | |
|---|---|
| ***F02D 41/24*** | (2006.01) |
| ***F02D 41/40*** | (2006.01) |
| ***F02D 41/36*** | (2006.01) |
| ***F02D 41/14*** | (2006.01) |
| ***F02D 41/22*** | (2006.01) |

(52) U.S. Cl.
CPC ..... *F02D 41/221* (2013.01); *F02D 41/2432* (2013.01); *F02D 41/2467* (2013.01); *F02D 41/365* (2013.01); *F02D 41/401* (2013.01); *F02M 61/167* (2013.01); *F02M 65/001* (2013.01); *F02D 2250/36* (2013.01); *F02D 2250/38* (2013.01)

(58) Field of Classification Search
CPC .. F02D 41/221; F02D 41/2467; F02D 41/365; F02D 41/2432; F02D 41/401; F02D 2250/36; F02D 2250/38
See application file for complete search history.

(56) References Cited

U.S. PATENT DOCUMENTS

| | | | | |
|---|---|---|---|---|
| 7,073,481 | B2 | 7/2006 | Glenn et al. | |
| 7,836,687 | B2 | 11/2010 | Stroia et al. | |
| 8,103,429 | B2 | 1/2012 | Sivasubramaniam et al. | |
| 9,010,087 | B1 * | 4/2015 | Upadhyay | F02D 41/1461 60/277 |
| 2007/0131203 | A1 * | 6/2007 | Ohga | F02D 41/1467 123/478 |
| 2008/0178656 | A1 * | 7/2008 | Nieuwstadt | G01M 15/102 73/23.31 |
| 2009/0206184 | A1 * | 8/2009 | Yan | F02M 47/027 239/584 |
| 2010/0037861 | A1 * | 2/2010 | Atzler | F02D 35/023 123/435 |
| 2010/0256954 | A1 | 10/2010 | Castella et al. | |
| 2012/0016563 | A1 * | 1/2012 | Ohsaki | F02D 41/221 701/102 |
| 2013/0152545 | A1 * | 6/2013 | Chavannavar | F01N 9/00 60/274 |
| 2014/0058646 | A1 * | 2/2014 | Shimada | F02D 41/30 701/104 |
| 2015/0361931 | A1 | 12/2015 | Talwar et al. | |
| 2016/0017826 | A1 * | 1/2016 | Lavertu | F02D 41/1444 60/274 |
| 2016/0069288 | A1 * | 3/2016 | Karunaratne | F02M 25/0755 123/681 |

OTHER PUBLICATIONS

Maaß, B., et al., "Diesel engine emissions prediction using parallel neural networks," American Control Conference, pp. 1122-1127 (Jun. 10-12, 2009).

Nelson-Gruel, D., et al., "Robust control applied to minimize NOx emissions," IEEE Conference on Control Applications (CCA), pp. 340-345 (Oct. 8-10, 2014).

* cited by examiner

METHOD AND SYSTEM FOR DETERMINING REMAINING USEFUL LIFE FOR AN INJECTOR OF A RECIPROCATING ENGINE

BACKGROUND

This invention relates generally to injectors used with reciprocating engines, for example in locomotives, and more particularly to method and system for determining remaining useful life of an injector.

A reciprocating engine, also often known as a piston engine, is a heat engine (usually, although there are also pneumatic and hydraulic reciprocating engines) that uses one or more reciprocating pistons to convert pressure into a rotating motion. Some of the commonly used reciprocating engines include the internal combustion engines, such as diesel engines. Other reciprocating engines include petrol engines, gasoline engines, dual fuel engines, etc. In the reciprocating engines, each piston is inside a cylinder, also called as combustion chamber, into which a gas is introduced, and heated inside the cylinder by ignition of a fuel air mixture.

Typically, a fuel injection system is used to introduce fuel in the cylinder, and can either be a unit injector system, combining an injection pump and an injector nozzle in a single integrated unit for each cylinder, or a common rail system, where a common injection pump is used for multiple cylinders, each cylinder having its own injector nozzle. The injector nozzle operates to allow the fuel to be injected into the cylinder under a pre-defined pressure. During the process of combustion, exhaust gases and particulate matter are usually produced, and are also generally referred to as emissions during the engine operating process. The composition of emissions may vary with the fuel type or rate of consumption, or speed of engine operation (e.g., idling or at speed), and whether the engine is in an on-road vehicle, farm vehicle, locomotive, marine vessel, or stationary generator or other application.

Usually, the engines are designed for fixed emission tolerances, and are periodically monitored for the emission levels. This is usually done by taking the engine out for maintenance periodically, and by running emission checks. Typically, when the emission levels are beyond tolerances, the fuel injector needs to be completely replaced for continued operation of the engine.

BRIEF DESCRIPTION

In one aspect, a method for determining remaining useful life of an in-use injector of a reciprocating engine is disclosed. The method includes determining nozzle wear relationship data for a plurality of duty cycles of the in-use injector. The method then includes receiving operating parameters for the reciprocating engine; and receiving emission relationship data predictive of emission levels for a standard injector operation. The method further includes determining actual emission levels for the in-use injector based on the wear relationship data and the emission relationship data; and determining remaining useful life of the in-use injector based on actual emission levels and the wear relationship data. The method then includes controlling an operation of the reciprocating engine based on the actual emission levels, if the remaining useful life of the in-use injector is within an operable range, or triggering a new injector procurement alarm if the remaining useful life of the in-use injector is not within the operable range.

In another aspect, a system for determining remaining useful life of an in-use injector of a reciprocating engine is disclosed. The system includes an input module configured for receiving one or more operating parameters related to the reciprocating engine. The system includes a nozzle wear relationship database having nozzle wear-relationship data for the in-use injector for a plurality of duty cycles; and an emission relationship database for storing emission relationship data predictive of emission levels for a standard injector operation. The system further includes an emission level calculator module for determining actual emission levels for the in-use injector based on the nozzle wear relationship data, and the emission relationship data. The system also includes a life determination module for determining remaining useful life of the in-use injector based on the actual emission levels; and a controller configured for controlling an operation of the reciprocating engine based on actual emission levels, if the remaining useful life of the in-use injector is within an operable range, or triggering a new injector procurement alarm if the remaining useful life of the in-use injector is not within the operable range.

DRAWINGS

These and other features, aspects, and advantages of the present invention will become better understood when the following detailed description is read with reference to the accompanying drawings in which like characters represent like parts throughout the drawings, wherein.

Figure 4A:
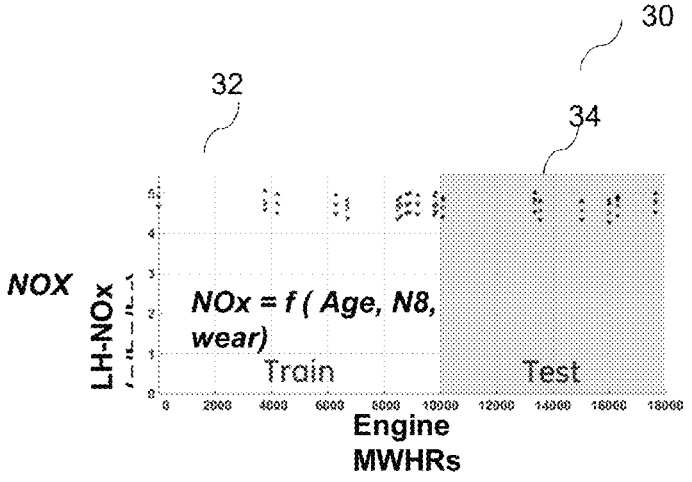
Figure 4B:
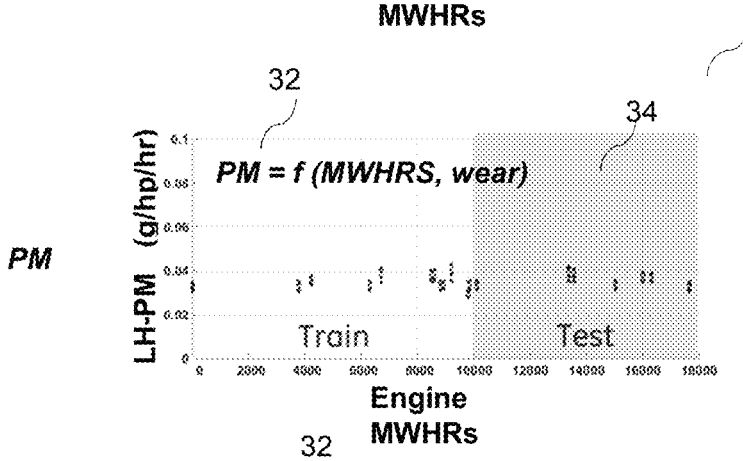
Figure 4C:
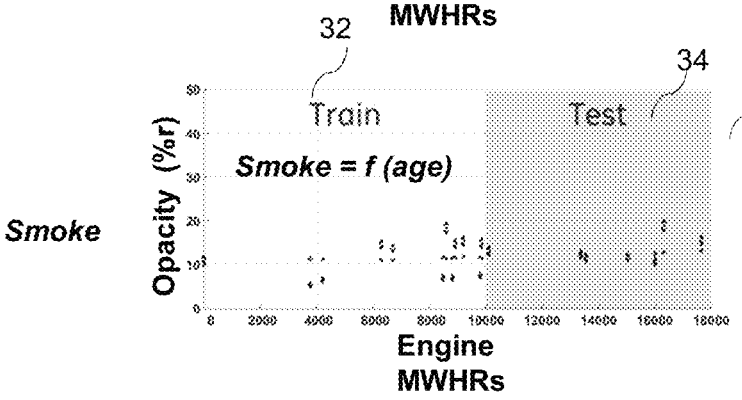
Figure 5:
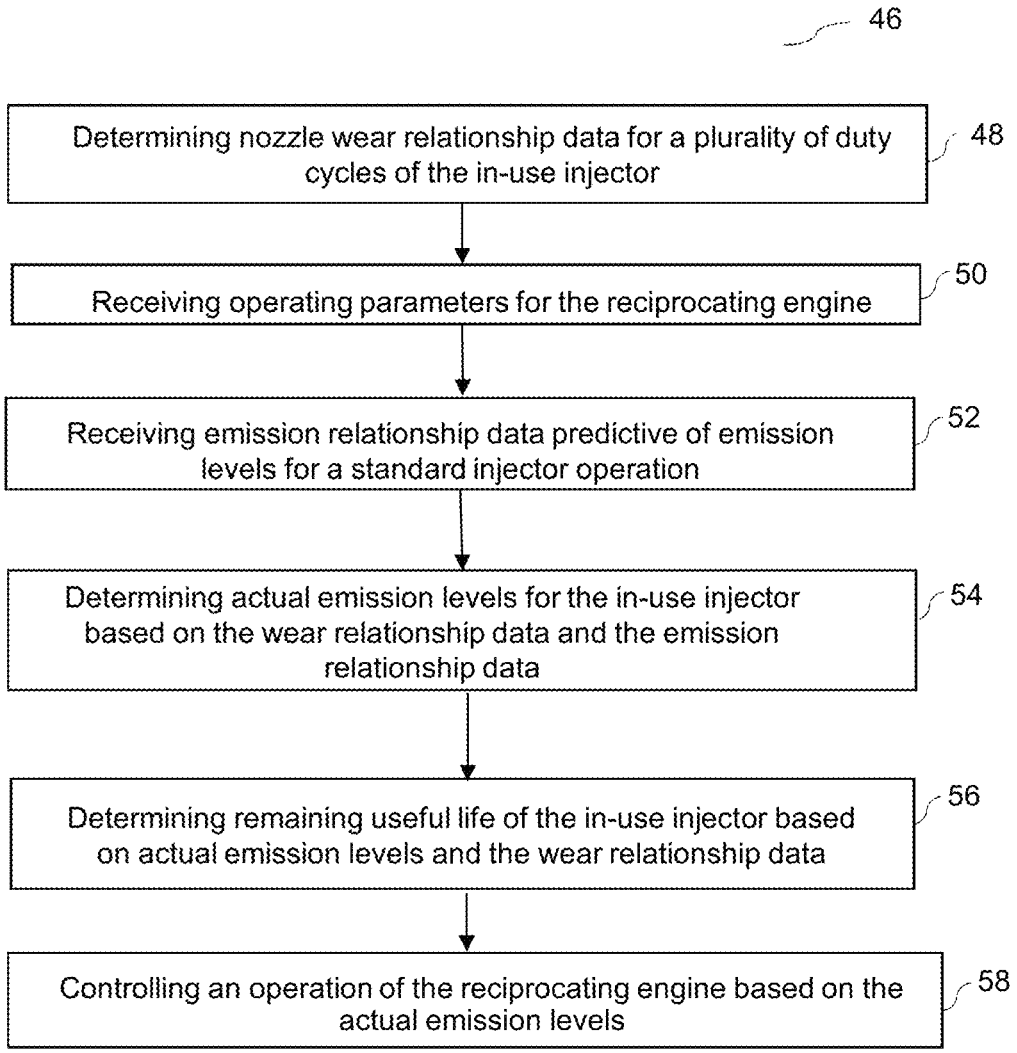
Figure 6:
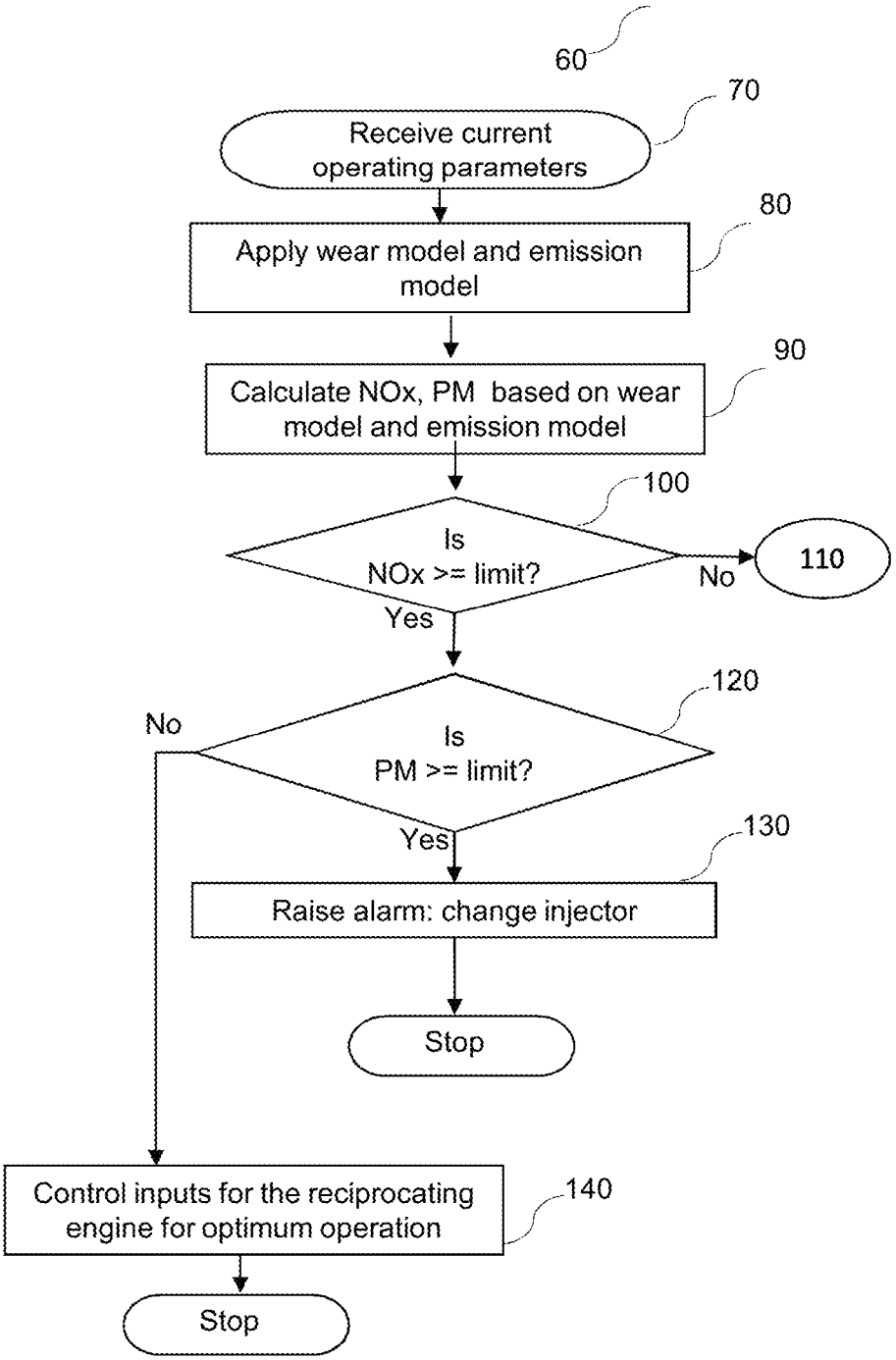
Figure 7:
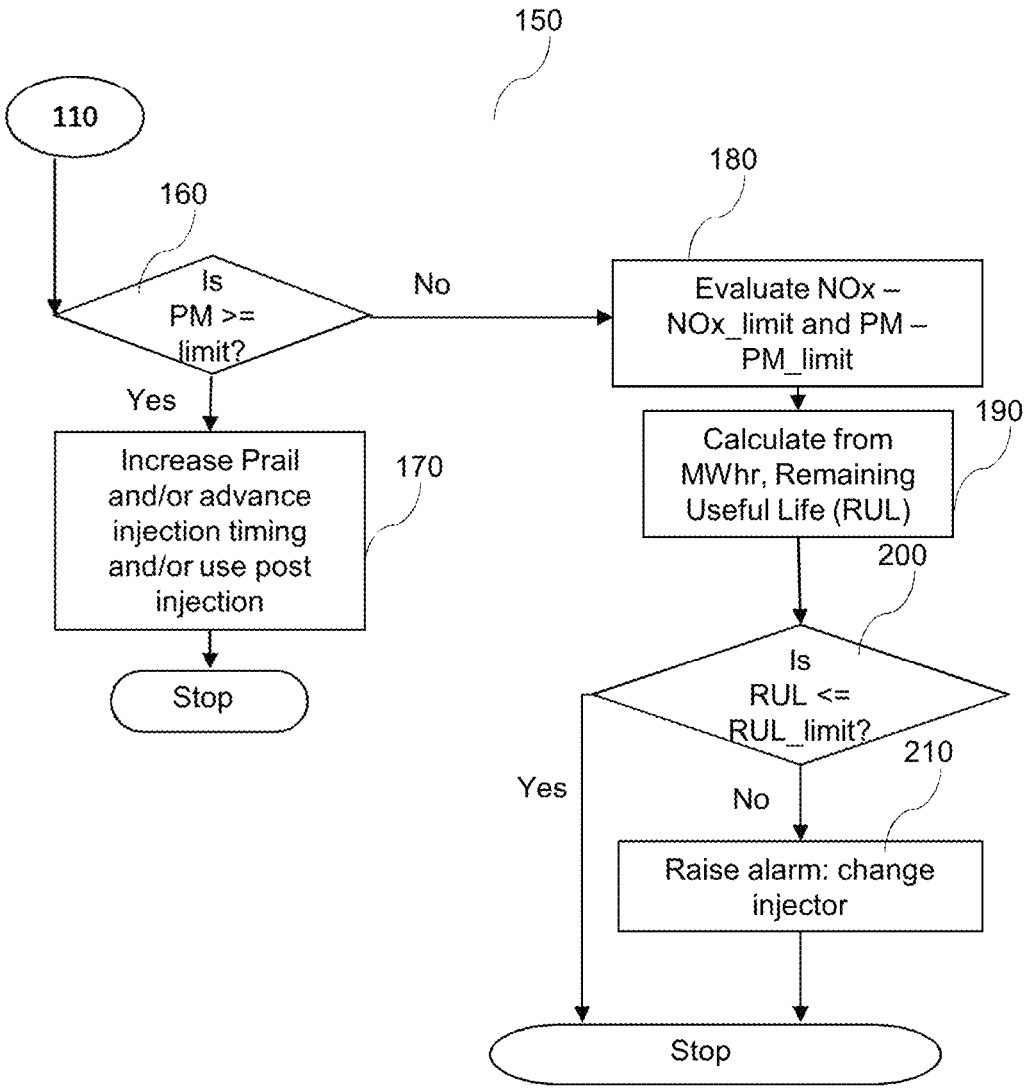
Figure 8:
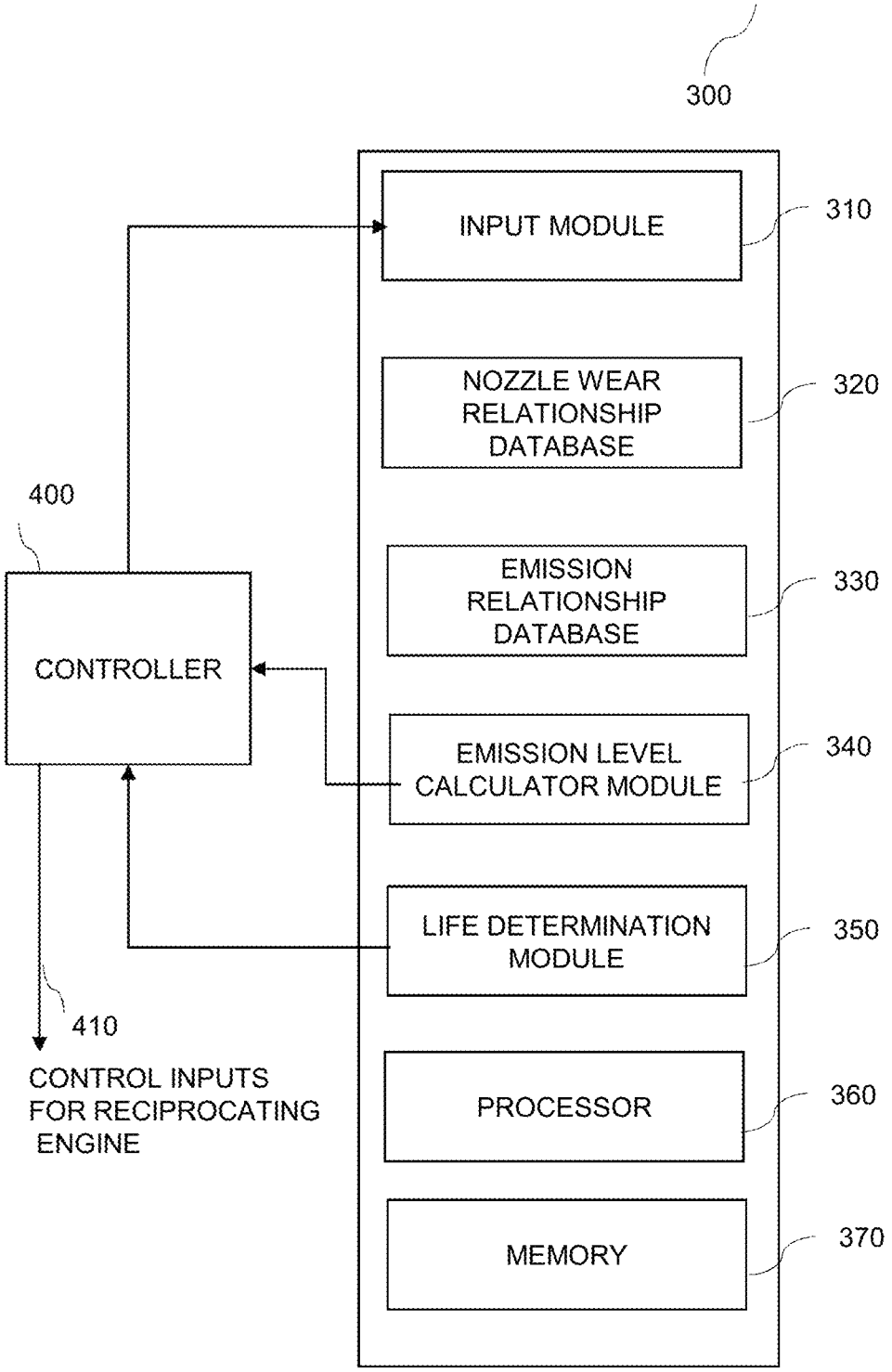

FIGS. 4A, 4B, and 4C are diagrammatic representations of wear-emission relationship for some exemplary emissions;

FIG. 5 is a diagrammatic representation of a method for determining for remaining useful life of an in-use injector of a reciprocating engine;

FIG. 6 and FIG. 7 are flowchart representations of a method for determining emission levels and remaining useful life of an in-use injector as outlined in FIG. 5; and FIG. 8 is a diagrammatic representation of a system for determining remaining useful life of the injector.

DETAILED DESCRIPTION

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

The reciprocating engines as described herein above require a fuel injection system that includes an injector nozzle for introducing a required amount of fuel in the cylinder(s) for combustion, and the process of combustion in the reciprocating engines generates emissions that need to be monitored and regulated to meet the environment and safety concerns. The aspects described herein relate to calculating remaining useful life of the injector, taking into account the emission levels in an operating reciprocating engine. The aspects described herein further provide an interlink between the injector physical properties and emission levels for an operating reciprocating engine. This in turn provides additional flexibility to control the operation of the reciprocating engine to extend the life of the injector within the permissible emission levels. For the purpose of clarity, the injector referred herein is described as "in-use injector", simply to highlight the in-use monitoring and control aspect for the injector, emission levels, and the operation of the reciprocating engine, and is not to be construed as a limitation in any manner, and therefore the term "injector" is also used to ensure proper coverage.

It would be appreciated by those skilled in the art that the injector nozzle undergoes erosion, cavitation, cracks, and other deformations during an operation of the reciprocating engine. As each reciprocating engine operates under different conditions, that include use in different vehicles, different terrains, different operators, and different ambient conditions, the type and extent of these deformations are unique for each injector, and this in turns impacts the combustion in the reciprocating engine, and the generation of emissions from the reciprocating engine.

The aspects described herein include developing a wear relationship database that is unique for individual injectors, and therefore each reciprocating engine, and more accurately captures the injector nozzle wear which is used further for determining, more accurately the emission generation from the engine. Thus the aspects described herein address the dual objective of both the emission control and monitoring, and injector life determination and optimization. Overall the aspects described herein improve the efficiency of the operation of the reciprocating engine.

Figure 1:
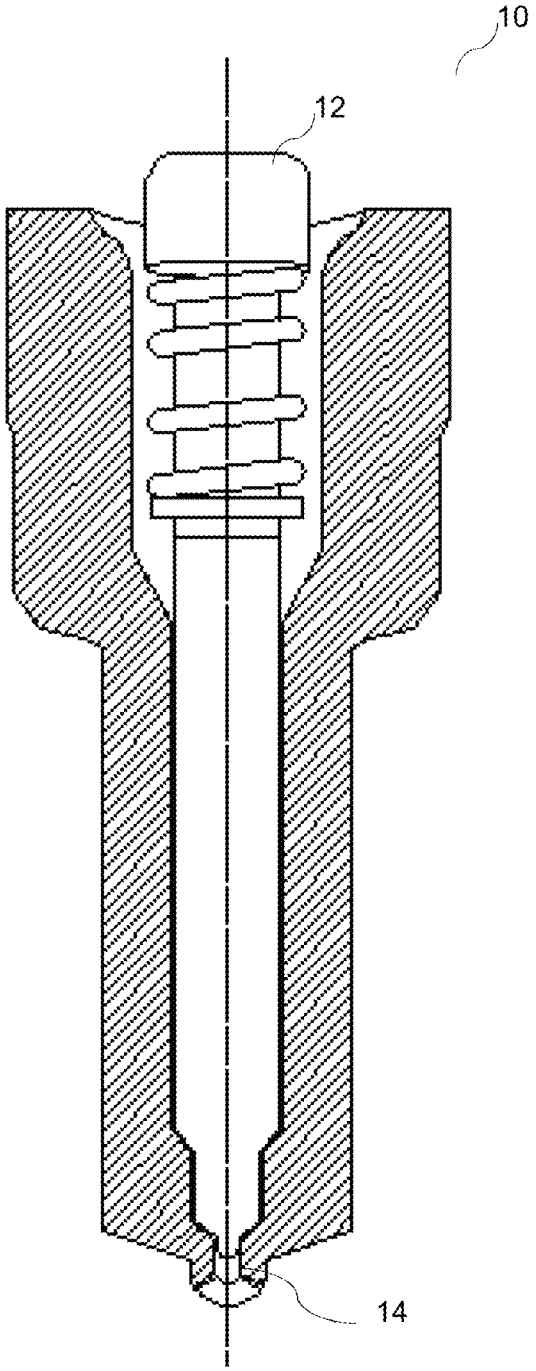
FIG. 1 is an exemplary representation of an injector used in a reciprocating engine for a vehicle.
Figure 2A:
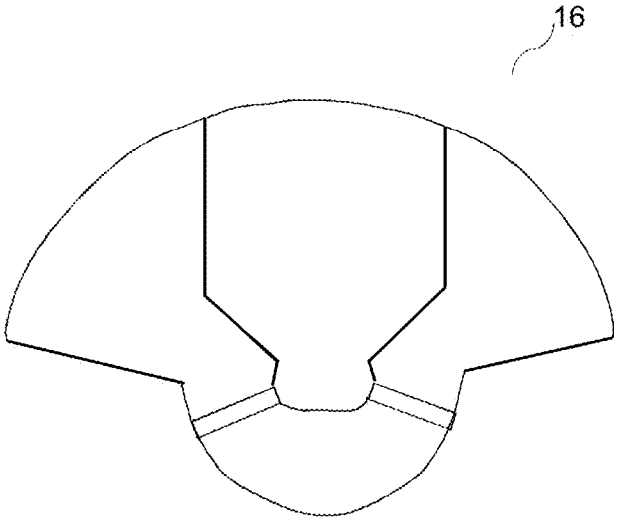
FIG. 2A and FIG. 2B are diagrammatic representations of an injector nozzle.
Figure 2B:
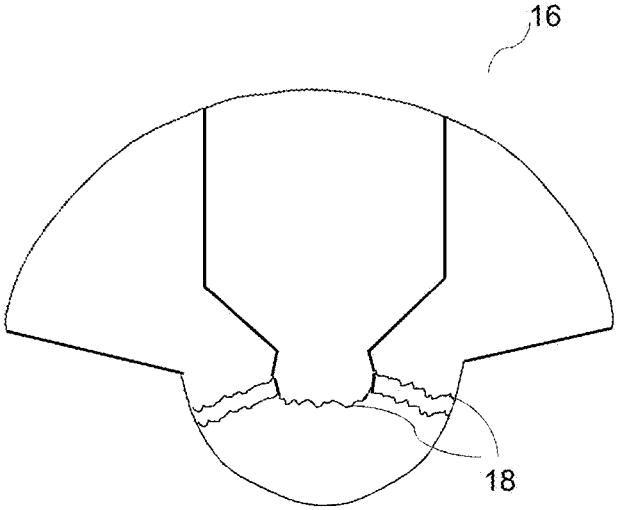

FIG. 1 is an image showing an injector 12 with an injector nozzle 14 of a reciprocating engine 10 (only a portion of the reciprocating engine is shown here), and FIG. 2A shows a blow-up for a new injector nozzle 16 prior to an operation of the reciprocating engine, and FIG. 2B shows the same injector nozzle 16, that is now incorporated within an in-use injector of an operating reciprocating engine, including the reciprocating engine, that has been under operation for some time. FIG. 2B shows certain deformations 18 in the injector nozzle, that occur, due to cyclic formation and collapse of bubbles on a surface of the injector nozzle. The bubble collapse leads to accelerated surrounding fluid (fuel/oil) to strike the surface and cause damages such as formation of hard and soft patches on the injector nozzle surface, cavitation, as well as crack formation in the injector nozzle. Such transient strike pressures are as high as 1.5 Gpa (Giga pascal).

Figure 3:
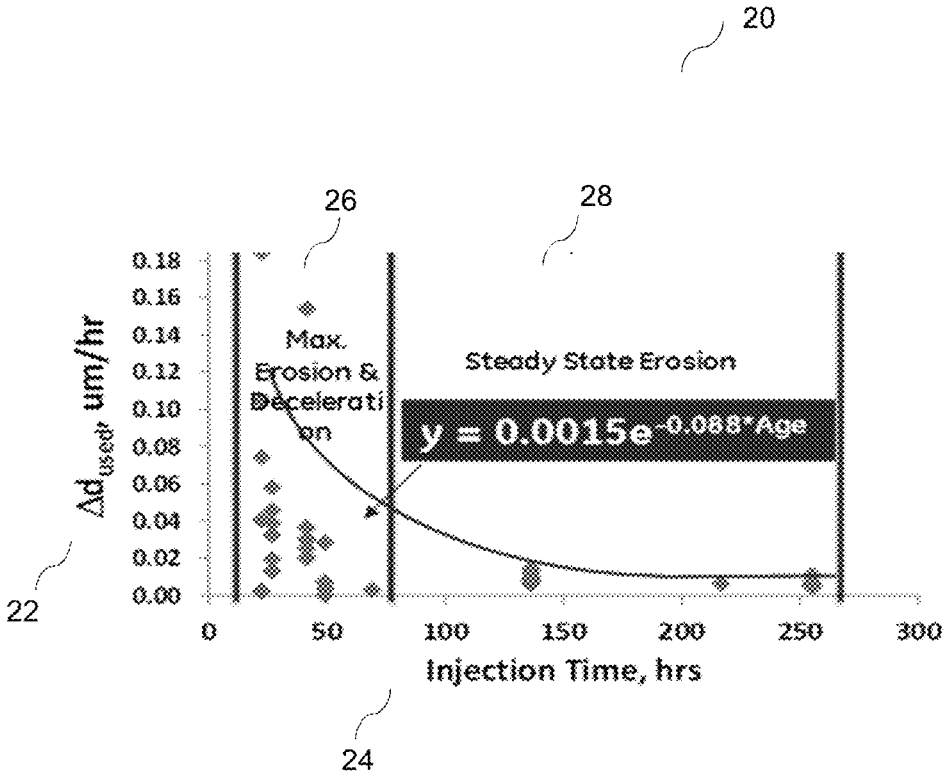
FIG. 3 is a diagrammatic representation of a wear model.

FIG. 3 is a representation of wear model 20 showing a relationship of nozzle wear i.e., change in diameter, $\Delta d_{used}$, in micro meters (um) per hour (hr)), shown on Y-axis 22 with respect to injection time in hours (hrs), which indicates the time for which the injector has been in operation, shown on X-axis 24. The maximum erosion region 26 and steady state erosion regions 28 for the reciprocating engine are shown, and the wear model is developed based on wear reports for the reciprocating engine. The wear reports are a collection of experimental data, where the change in diameter (in percentage) of the nozzle, i.e. the nozzle wear or wear grade is derived for different time periods of injector use, that is also referred herein as injector age. The change in diameter of nozzle is derived by measuring the change in fluid flow through the nozzle at a specified pressure. The following equation is derived from the wear reports:

$$y=0.0015e^{-0.088*Age(injector\ age)} \quad \text{Equation 1}$$

where 'y' is a coefficient used for determining the nozzle wear. In the wear reports, the change in nozzle diameter (in percentage) is depicted as wear grade. The fluid (fuel/oil) flow increase and decrease due to erosion related deformations of the nozzle are taken into consideration for the wear model. Through the wear model, the nozzle diameter for a current duty cycle of the injector can be determined, both of which (nozzle diameter, and duty cycle) are later used to map with the emission levels using an emission model. Other parameters that are determined through the wear model include fluid flow, and injector wear profile. Operating parameters such as ambient pressure, ambient temperature are also used in the calculations for determining remaining useful life of the injector and emission levels, using the emission model explained herein below.

The emission models referred herein are linear regression class of models. The features used in these emission models include injector age, MWHR (Megha Watt Hour, that is the operating power of the reciprocating engine at a given time) and notch 8 hours (which is the duty cycle for the injector) in determining emission levels. Typically, emission models used in prior art systems do not include the nozzle wear as an input for determining the emission levels. The wear model developed using wear reports is therefore combined with these linear regression class of models to further tune and improve the model estimates/predictions of emission levels, by including additional feature inputs of nozzle wear, and more accurate determination of duty cycle, and injector age, that is made available from the wear model.

FIG. 4A, 4B, 4C are graphical representations of use of emission model in conjunction with the wear model. As seen in FIG. 4A, emission levels for NOx (Nitrogen Oxides) (graphical representation 30), are derived as a function of injector age, duty cycle referred by N8, and wear, i.e. nozzle wear referred herein above. Similarly, referring to FIG. 4B, the emission level for particulate matter (PM) (graphical representation 40) is derived as a function of operation of reciprocating engine in MWhrs (Mega Watt hours) and wear, i.e. nozzle wear. And referring to FIG. 4C, the smoke level measured as percentage opacity of smoke is derived as a function of injector age.

In the representations 30, 40, and 42, of FIG. 4A, FIG. 4B, and FIG. 4C respectively, both training data 32 and test data 34 are shown. The training data is developed using wear reports and actual measurements of emission levels, and is used to estimate the coefficient(s) of emission model, referred in equation 1, herein above. The test data depicts the prediction of emission levels based on the trained data.

Thus, using the emission model in conjunction with the wear model, more accurate emission levels can be predicted for a particular duty cycle of the reciprocating engine. This technique, therefore includes the consideration of the current operating condition of the injector nozzle to predict the emission levels, and further determines the remaining useful life for the injector nozzle and optimum operating conditions for the reciprocating engine based on the remaining useful life of the injector nozzle. It would be understood by those skilled in the art that the permissible limits of different emissions referred herein are standard limits determined by environmental agencies, or limits determined by national or international standard organizations, or industry bodies. As an example, NOx limit in one example is 5.5 g/hp/hr (grams/horse power/hour), PM limit is 0.10 gm/hp/hr, and Smoke Opacity limit is 50%.

The above aspects are presented as a series of steps in flowchart 46 in FIG. 5 that outline a method for determining remaining useful life of an in-use injector of a reciprocating engine, the method includes a step 48 for determining nozzle wear relationship data for different duty cycles of the in-use injector which has been detailed herein above. The method then includes a step 50 for receiving operating parameters for the reciprocating engine, a step 52 for receiving emission relationship data predictive of emission levels for a standard injector operation, a step 54 for determining actual emission levels for the in-use injector based on the wear relationship data and the emission relationship data; a step 56 for determining remaining useful life of the in-use injector based on actual emission levels and the wear relationship data; and a step 58 for controlling an operation of the reciprocating engine based on the actual emission levels, if the remaining useful life of the in-use injector is within an operable range, or triggering a new injector procurement alarm if the remaining useful life of the in-use injector is not within the operable range. These different steps are outlined in more detail in reference to FIG. 6 and FIG. 7.

Now, referring to FIG. 6, a flowchart 60, describes in more detail the various steps of above referenced flowchart 46 for determining emission levels, remaining useful life of the injector of the reciprocating engine, and control inputs for optimal working of the reciprocating engine keeping both the injector wear and emission levels as a consideration, using the principles described herein above. As shown in flowchart 60, at step 70, current operating parameters such as the number of hours the reciprocating engine has been operating, ambient temperature and ambient pressure are received. At step 80, nozzle wear model for different duty cycles of the injector is used along with the current operating parameters to determine the current nozzle diameter and injector profile, the current duty cycle, and a change in hydraulic flow of the fuel/oil based on the injector profile, is also determined. The current duty cycle referred to herein means the present duty cycle of the injector under active operation. This implies that the injector is not taken offline, or out of operation at all, which is very advantageous, as it allows the reciprocating engine to remain in operation, and hence adds to productivity. Also at step 80, emission model is applied that maps the emission parameter data predictive of emission levels for a standard reciprocating engine for different duty cycles. At step 90 actual emission levels for the injector based on the wear-data and the emission parameter data are determined.

Subsequent steps are related to decision and control aspects of the described method for controlling the operation of the reciprocating engine. At step 100, the determined NOx level is checked, if it is within a permissible limit. If the NOx level is greater than or equal to the permissible limit, then the method checks if the particulate matter level (PM level) is greater than or equal to the permissible limit at step 120. If the PM level is also, greater than or equal to the permissible limits then an alarm is raised at step 130 indicating a requirement of change of the injector. In case the PM level is less than the permissible limit, then control inputs such as reducing pressure in the nozzle, retarding injection timing, increasing engine speed, reducing MAT (manifold air temperature), and increasing IVC (intake valve close timing), timing are initiated at step 140 to ensure that NOx levels are reduced, while PM level is within the permissible limit.

FIG. 7 through the flowchart 150, depicts the method steps that are used when the NOx level is less than the permissible limits as shown at 110 in FIG. 6. At step 160, the PM level is checked if it is greater than or equal to the permissible limits. If it is, then as shown at step 170, control inputs for the operation of the reciprocating engine are generated that include increasing of injector pressure, and/or advance the injection timing, and/or use of post injection. If the PM level is also below the permissible limit, then a difference between the actual NOx level and NOx limit, as well a difference between the actual PM level and PM limit is evaluated at step 180. These differences are then mapped with the wear model to determine a limit for remaining useful life of the injector, given the present differences of the NOx and PM levels with the permissible limits for these emissions. The actual remaining useful life is calculated using the duty cycle and the operation of the reciprocating engine in MWhr. Next at step 200, it is checked whether the remaining useful life is less or equal to the limit of the remaining useful life. If it is less, then an alarm indication is generated for change of injector i.e. a new injector procurement alarm is triggered. The trigger may be in the form of a visual alarm, an audio alarm, a text alert, a short message service type of alert, or a combination of two or more of these.

If the remaining useful life is more than the limit of the remaining useful life, then the method continues to monitor the emission levels, starting at step 70 of the FIG. 6. It would be appreciated by those skilled in the art, that when the remaining useful life of the injector is within the permissible limits, at least one of an operation of the injector or the reciprocating engine is controlled based on the determined remaining useful life of the injector. For example, when the remaining useful life of the injector is within an operable range, the injector operation continues, and select injector operation parameters are generated for controlling an optimum working of the injector, such as but not limited to, controlling at least one of rail pressure, injection timing, speed of the reciprocating engine, and IVC timing.

It would be appreciated by those skilled in the art that the nozzle wear-emission relationship data is updated during a continued operation of the injector.

In another aspect, a system 300 for determining remaining useful life of an injector of a reciprocating engine is disclosed, and is shown in FIG. 8. The system 300 includes an input module 310 configured for receiving one or more operating parameters related to the reciprocating engine, the operating parameters may be received by the input module 310 from a controller 400 of the reciprocating engine. The system further includes a nozzle wear relationship database 320 having nozzle wear relationship data for the injector for different duty cycles. From the wear relationship data and current operating parameters, including but not limited to engine running time, ambient temperature, ambient pressure, a current duty cycle for the injector, a change in hydraulic flow, an injector profile, are determined. As explained herein above the nozzle wear relationship data is implemented using physics based derivations for nozzle wear over time based on usage of the particular injector. The wear relationship data is updated during a continued operation of the injector.

The system includes an emission relationship database 330 or emission model for storing emission parameter data predictive of emission levels for a standard injector operation. An emission level calculator module 340 is used for determining actual emission levels for the injector based on the nozzle wear relationship data and emission relationship data. The actual emission levels are determined for emissions such as but not limited to NOx emission and particulate matter emission.

A life determination module 350 is used for determining remaining useful life of the injector based on the actual emission levels derived from the emission level calculator. The controller 400 is configured for controlling at least one of an operation of the injector or the reciprocating engine based on the determined emission levels, and also if the remaining useful life of the injector, as calculated by the life determination module is within an operable range, or triggering a new injector procurement alarm if the remaining useful life of the injector is not within the operable range. The controller 400 thus operates to generate control inputs 410 for controlling the operation of the reciprocating engine, and the control inputs are for example, but not limited to, at least one of rail pressure, injection timing, speed of the reciprocating engine, and IVC timing.

It would be understood by those skilled in the art that the different modules described in reference to system 300 referred herein above are configured using a processor 360 and a memory 370. The processor 360 may include at least one arithmetic logic unit, microprocessor, general purpose controller or other processor arrays to perform computations, and/or retrieve data stored on the memory. In one embodiment, the processor may be a multiple core processor. The processor processes data signals and may include various computing architectures including a complex instruction set computer (CISC) architecture, a reduced instruction set computer (RISC) architecture, or an architecture implementing a combination of instruction sets. In one embodiment, the processing capability of the processor may be limited to supporting the retrieval of data and transmission of data. In another embodiment, the processing capability of the processor may also perform more complex tasks, including various types of feature extraction, modulating, encoding, multiplexing, and the like. Other type of processors, operating systems, and physical configurations are also envisioned.

In one embodiment, the memory 370 described herein above may be a non-transitory storage medium. For example, the memory may be a dynamic random access memory (DRAM) device, a static random access memory (SRAM) device, flash memory or other memory devices. The memory may also include a non-volatile memory or similar permanent storage device, and media such as a hard disk drive, a floppy disk drive, a compact disc read only memory (CD-ROM) device, a digital versatile disc read only memory (DVD-ROM) device, a digital versatile disc random access memory (DVD-RAM) device, a digital versatile disc rewritable (DVD-RW) device, a flash memory device, or other non-volatile storage devices.

In accordance with an embodiment, a computer program application stored in non-volatile memory or computer-readable medium (e.g., register memory, processor cache, RAM, ROM, hard drive, flash memory, CD ROM, magnetic media, etc.) may include code or executable instructions that when executed may instruct and/or cause a controller or processor to perform methods discussed herein.

The computer-readable medium may be a non-transitory computer-readable media including all forms and types of memory and all computer-readable media except for a transitory, propagating signal. In one implementation, the non-volatile memory or computer-readable medium may be external memory.

Thus, the method and system described herein above address the need for the reciprocating engines to operate within the permissible emission levels as well as for optimizing the injector life by incorporating an effect of wear on the emissions, thus allowing for an overall safer and more productive operation of the reciprocating engine, that is an important requirement for locomotives and other mass-use or critical vehicles.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for determining remaining useful life of an in-use injector of a reciprocating engine, the method comprising:

determining nozzle wear relationship data for a plurality of duty cycles of the in-use injector;

receiving operating parameters for the reciprocating engine;

receiving emission relationship data predictive of emission levels for a standard injector operation;

determining actual emission levels for the in-use injector based on the nozzle wear relationship data, the emission relationship data, and the received operating parameters;

determining remaining useful life of the in-use injector based on the actual emission levels, the nozzle wear relationship data, and the received operating parameters; and controlling an operation of the reciprocating engine based on the actual emission levels, if the remaining useful life of the in-use injector is within an operable range, or triggering a new injector procurement alarm if the remaining useful life of the in-use injector is not within the operable range.

2. The method of claim 1 wherein the nozzle wear relationship data is updated during a continued operation of the in-use injector.

3. The method of claim 1 wherein determining the actual emission levels for the in-use injector comprises determining the actual emission levels for the in-use injector based on a current duty cycle for the in-use injector, a change in hydraulic flow of the in-use injector, an injector profile of the in-use injector, current ambient pressure, and current ambient temperature.

4. The method of claim 3 wherein the actual emission levels are determined for NOx emission, particulate matter emission, and a combination thereof.

5. The method of claim 1, wherein controlling at least one operation of the in-use injector comprises controlling at least one of rail pressure, injection timing, speed of the reciprocating engine, manifold air temperature, and intake valve close timing.

6. A system for determining remaining useful life of an in-use injector of a reciprocating engine, the system comprising:

an input module configured for receiving one or more operating parameters related to the reciprocating engine;

a nozzle wear relationship database having nozzle wear-relationship data for the in-use injector for a plurality of duty cycles;

an emission relationship database for storing emission relationship data predictive of emission levels for a standard injector at each of a plurality of nozzle wear levels;

an emission level calculator module for determining actual emission levels for the in-use injector based on the nozzle wear relationship data, and the emission relationship data;

a life determination module for determining the remaining useful life of the in-use injector based on the actual emission levels; and a controller configured for controlling an operation of the reciprocating engine based on the actual emission levels, if the remaining useful life of the in-use injector is within an operable range, or triggering a new injector procurement alarm if the remaining useful life of the in-use injector is not within the operable range.

7. The system of claim 6, wherein the nozzle wear relationship data is updated during a continued operation of the in-use injector.

8. The system of claim 6, wherein the actual emission levels for the in-use injector are based on a current duty cycle for the in-use injector, a change in hydraulic flow, an injector profile, current ambient pressure, and current ambient temperature.

9. The system of claim 8, further comprising wherein the actual emission levels are determined for NOx emission, particulate matter emission, or a combination thereof.

10. The system of claim 6, wherein the controller is further configured for controlling at least one of rail pressure, injection timing, speed of the reciprocating engine, manifold air temperature, and intake valve close timing.

11. The method of claim 1, wherein the emission relationship data includes a model trained using nozzle wear relationship data and associated measured emission levels for each of the plurality of duty cycles, and wherein determining actual emission levels for the in-use injector based on the nozzle wear relationship data, the emission relationship data, and the received operating parameters comprises entering the nozzle wear relationship data for the in-use injector and the received operating parameters into the model, wherein the received operating parameters include at least a current duty cycle of the in-use injector.

12. The method of claim 1, wherein determining the remaining useful life of the in-use injector based on the actual emission levels, the nozzle wear relationship data, and the received operating parameters includes determining a difference between a first emission level of the actual emission levels and an emission limit, and mapping the difference and the received operating parameters with the nozzle wear relationship data to determine if the remaining useful life of the in-use injector is within the operable range.

13. The system of claim 6, wherein the emission level calculator module is configured to determine the actual emission levels for the in-use injector based on the nozzle wear relationship data, and the emission relationship data by:

obtaining a current duty cycle;

determining a current nozzle wear level for the in-use injector based on the current duty cycle and the nozzle-wear relationship data; and determining the actual emission levels for the in-use injector based on the current nozzle wear level and the emission relationship data.

* * * * *